US005335465A

United States Patent [19]

Gueret

[11] Patent Number: 5,335,465

[45] Date of Patent: * Aug. 9, 1994

[54] MASCARA BRUSH AND METHOD OF MANUFACTURE

[75] Inventor: Jean-Louis Gueret, Paris, France

[73] Assignee: L'Oreal, Paris, France

[ * ] Notice: The portion of the term of this patent subsequent to Feb. 6, 2007 has been disclaimed.

[21] Appl. No.: 536,462

[22] Filed: Jun. 12, 1990

[30] Foreign Application Priority Data

Jul. 26, 1989 [FR] France ..... 89 10084

[51] Int. Cl.[5] ..... A45D 40/26

[52] U.S. Cl. ..... 132/218; 132/320

[58] Field of Search ..... 132/216, 218, 320; 401/122, 129; 15/159 A, 206

[56] References Cited

U.S. PATENT DOCUMENTS

| | | | |
|---|---|---|---|
| 3,892,248 | 7/1975 | Kingsford | 132/218 |
| 3,930,280 | 1/1976 | Vasas | 132/317 X |
| 3,998,235 | 12/1976 | Kingsford | 132/218 |
| 4,600,328 | 7/1986 | Clements | 132/218 X |
| 4,898,193 | 2/1990 | Gueret | 15/206 X |
| 4,964,429 | 10/1990 | Cole | 401/129 X |

FOREIGN PATENT DOCUMENTS

| | | |
|---|---|---|
| 2605505 | 10/1986 | France . |
| 2170996 | 8/1986 | United Kingdom . |

*Primary Examiner*—John J. Wilson
*Assistant Examiner*—Jeffrey A. Smith
*Attorney, Agent, or Firm*—Cushman, Darby & Cushman

[57] ABSTRACT

A brush for applying mascara to the eyelashes including long bristles and short bristles, the long bristles forming at least one crest on the brush. The crest or crests form a helix the pitch of which equals from one to four times the length of the brush.

9 Claims, 3 Drawing Sheets

MASCARA BRUSH AND METHOD OF MANUFACTURE

FIELD OF THE INVENTION

The present invention relates to a brush for applying mascara to the eyelashes.

BACKGROUND OF THE INVENTION

Brushes generally used for applying mascara to the eyelashes are made up of bristles disposed on a core or support made of twisted iron wire. The bristles are fixed radially on this same core in such a way as to form rings, or more frequently a helix. The outer envelope defined by the end of the bristles may have a cylindrical, cylindroconical or conical shape. The twisted iron wire is generally fixed in a sleeve that makes it possible to manipulate the brush.

Mascara brushes are meant to be used for makeup having the following three characteristics: It separates the eyelashes well, so that they do not stick together in clumps; it is homogeneous; and only a minimum number of passes of the brush is needed. For good separation of the eyelashes and to prevent them from sticking together, the bristles of the brush must be able to pass between two eyelashes, separating them; in other words, the brush combs the eyelashes. If the makeup is to be homogenous, the brush must be able to coat the eyelash with mascara over its entire length, and with a constant quantity of mascara.

In British Patent Application BG A 2 170 996, a brush that includes long bristles and short bristles has been proposed. The long bristles form naps disposed in longitudinal rows or in the form of a helix; the width of the nap of long bristles is not insignificant and is too large to enable good separation of adjacent eyelashes.

In French Patent Application FR A 2 605 505, the applicant has proposed a brush including long bristles and shorter bristles in which the thickness of the crests, measured at the periphery of the brush, equals at most 1.5 mm. Particularly in a plane perpendicular to the core, the ends of the bristles form an envelope comprising a polygon having from three to six sides, which are rectilinear or concave. These brushes improve combing of the eyelashes, and each of the apexes of the polygon, which is made up of tufts of approximately 2 to 4 long bristles, acts as a comb.

The successive apexes are separated by an interval equal to the distance between two rings of bristles, or to the pitch of the helix, and they are aligned longitudinally in such a manner as to form a crest. Hence the crest forms a rectilinear "comb". The eyelashes enter between the teeth of the "comb" and are separated, while sweeping the makeup product located on the shorter bristles into the zone connecting the crests. Both good separation and good coating of the eyelashes are obtained.

OBJECT AND SUMMARY OF THE INVENTION

In the present invention, it has been found that the separation of the eyelashes is improved still further when the crest comprising the long bristles (or "comb") is not rectilinear but instead is slightly twisted into a helix.

Hence the subject of the present invention is a brush for applying mascara to the eyelashes comprising an elongated core that is surrounded at least partially by bristles held by and extending radially from the core and distributed substantially regularly, so as to form at least one crest of long bristles surrounded by shorter bristles, in which the ends of the bristles define a contour, in projection in a plane perpendicular to the core or in the plane, and the thickness of the crests measured at the periphery of the brush is equal at most to 3 mm, characterized in that the crest or crests form a helix the pitch of which equals 1 to 4 times the length of the brush.

In other words, the crest is twisted by from one-quarter of a turn to one turn.

It will be appreciated that when the crests are disposed in a helix, adjoining eyelashes will not be made up at the same time by the brush, but with a slight delay; this delay thus permits better separation of the eyelashes. When the helix is overly tight, that is, when the pitch of the helix is less than one length of the brush, good separation of the eyelashes is not assured. Furthermore, when the helical pitch is greater than 4 times the length of the brush, there is no further notable improvement compared with a brush where the crests are aligned longitudinally.

It should be noted that mascara brushes generally have a length of between 20 and 30 mm.

Moreover, according to the present invention, the passage from long bristles to short bristles over an eyelash or a group of eyelashes takes place equally progressively when a slight rotational motion or a slight longitudinal displacement motion is imparted to the brush. Thus regular coating of the eyelashes is more easily obtained.

According to the invention, the contour defined in projection by the end of the bristles may have the shape of a regular polygon with from three to six sides, an ellipse, a shuttle, or a semicircle closed off by an isosceles triangle.

In the case where the contour is an ellipse or a shuttle, the contour is preferably eccentric with respect to the core of the brush.

The invention also relates to a method of manufacture, in which a brush having a cylindrical, cylindroconical or conical outer envelope is made, in which the bristles are disposed on the core in rings or in a helix, and the length of the bristles is subsequently rectified by peripheral milling or grinding so that the end of the bristles defines the desired envelope; it is characterized in that after milling or grinding, the core is twisted by from one-quarter to one turn, such that the crests form a helix having a pitch equal to from 1 to 4 times the length of the brush.

In a particular method of manufacture, the core of the brush is formed by folding a metal wire over a row of bristles; twisting the thus doubled wire to lock the bristles in place about the bore in helical rows of radial bristles; and subsequently rectifying the bristles by peripheral milling or grinding so that the end of the bristles forms the desired contour; after milling or grinding, the core of the brush is twisted again in such a manner that the crests form a helix having a pitch equal to from 1 to 4 times the length of the brush. Generally, the diameter of the bristles used may vary between 0.06 and 0.25 mm.

The bristles may be natural or synthetic in origin and are preferably of polyamide (nylon). Their cross section may be circular or polygonal, or they may have at least one capillary groove over their entire length.

For better comprehension of the subject of the invention, several purely exemplary, non-limiting embodiments will be described in further detail below, as shown in the accompanying drawings.

DESCRIPTION OF THE PREFERRED EMBODIMENTS

Figure 1:
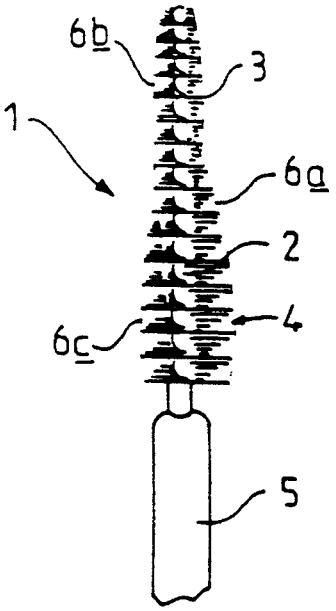
FIG. 1 is an elevation view of a brush with helical crests, according to the present invention.
Figure 3:
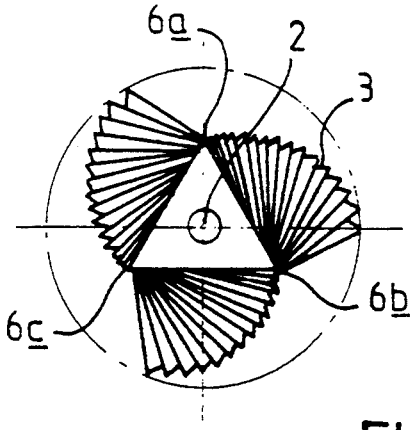
FIGS. 3, 3*a*, 3*b*, 4–7 are schematic views of the ends of brushes, according to the invention.
Figure 4:
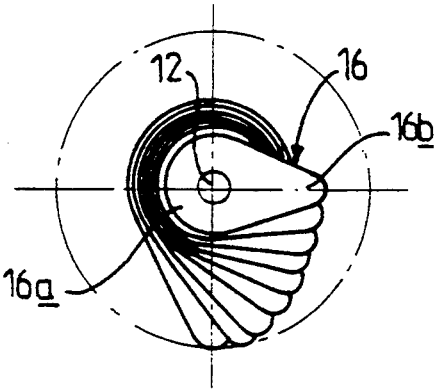

FIGS. 1 and 3 show a brush according to the invention, which is designated as a whole by reference numeral 1. The brush 1 comprises a core 2 formed by a twisted metal wire on which the bristles 3 are fixed in helixes 4. The core 2 is mounted to extend axially from a stem 5. The brush is inscribed in a cone, the point of which is at the end of the brush. The ends of the bristles define a contour that is a substantially equilateral triangle (see FIG. 3), in projection on a plane perpendicular to the core 2. The brush thus has three crests 6*a*, 6*b*, 6*c*, shown in dot-dash lines in FIG. 1. In this embodiment of the brush shown in FIGS. 1 and 3, the crest 6*a* describes a one-quarter turn over the length of the brush; that is, the path of the helix equals one-fourth the length of the brush.

Figure 2:
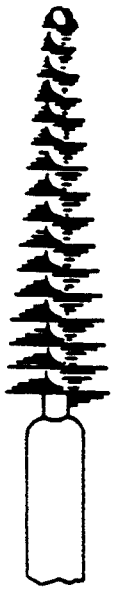
FIG. 2 Prior Art
FIG. 2 is an elevation view of a non-twisted brush as found in the prior art.

FIG. 2, for comparison, shows a brush according to the prior art which is identical to the brush shown in FIGS. 1 and 3 except that the crests are rectilinear rather than in helical form.

Figure 3A:
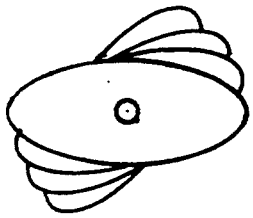
Figure 3B:
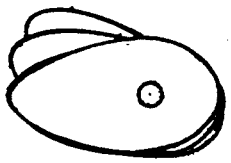

FIGS. 3, 3*a* and 3*b* show various contours of the bristles with FIGS. 3*a* and 3*b* showing the contour in the shape of an ellipse. In FIG. 3*b*, the elliptical contour is shown eccentrically with respect to the core 2.

FIGS. 4–7 show various contours defined by the ends of the bristles, in projection in a plane perpendicular to the core of the brush. In the FIG. 4, the contour 16 comprises a semicircle 16*a* centered on the core 12 of the brush, which is joined at the diameter to an isosceles triangle 16*b* the apex of which is rounded.

Figure 5:
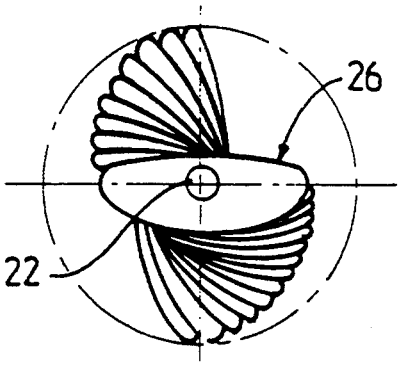

In FIG. 5, the contour 26 takes the shape of a shuttle, and the core 22 is disposed outside the center of symmetry of the shuttle and, in the embodiment shown, on the short axis of symmetry of the shuttle.

Figure 6:
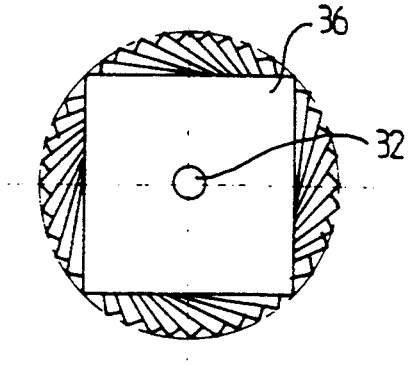

In FIG. 6, the brush has a cylindrical outer envelope. The contour 36 has the shape of a square, and the core 32 passes through the center of the square.

Figure 7:
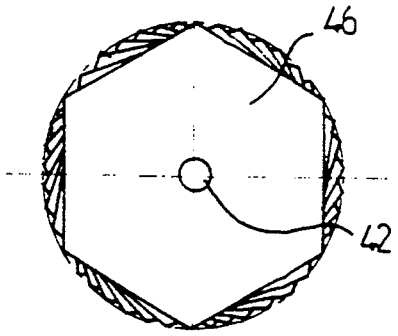

In FIG. 7, the brush also has a cylindrical outer envelope. The contour 46 has the form of a hexagon centered on the core 42.

Figure 8:
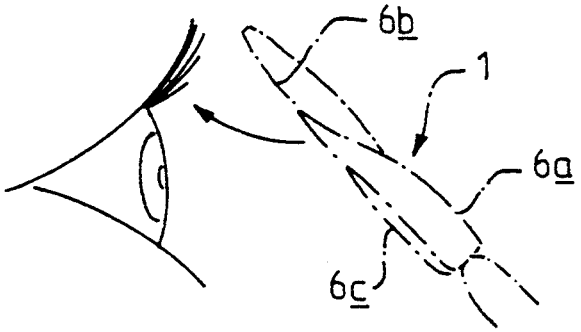
FIGS. 8 and 9 schematically show the relative positions of the eyelashes and brush while makeup is being applied.
Figure 9:
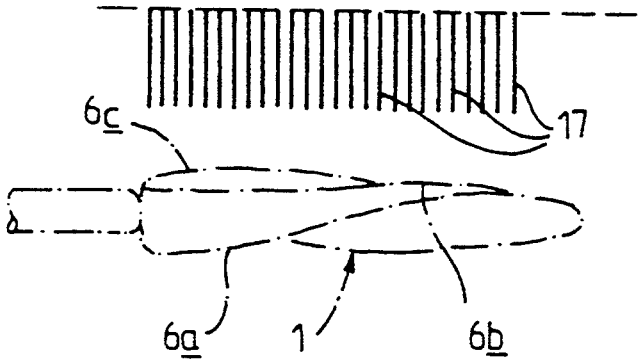

When the user wishes to make up her eyelashes with the brush according to the invention, she brings the brush 1 up to her eyelashes 17 as shown in FIGS. 8 and 9. The eyelashes are well separated by the three crests 6*a*, 6*b*, 6*c*, which form a "comb". As schematically shown in FIG. 9, two adjacent eyelashes 17 are engaged by the brush in slightly staggered fashion, which permits better separation of the eyelashes. Furthermore, if a rotational motion is imparted to the brush, for example by a one-quarter turn, or if the brush is displaced longitudinally, the eyelashes are progressively in contact with increasingly long bristles or increasingly short bristles, which improves the homogeneity with which the eyelashes are coated.

A brush according to the invention has a progressive helix from one end of the brush to the other and assures a highly progressive passage from short to long bristles, which makes it possible for these bristles to penetrate progressively to the base of the eyelashes and thereby smooth the eyelashes.

With the brush according to the invention, eyelash makeup can be applied quickly, with a variably heavy coating, and with the eyelashes perfectly well separated. Both the degree of twisting and the number of twisted crests are elements in both makeup differentiation and manipulation.

The brush can be reground in certain regions to obtain different outlines.

The brush according to the invention, while made with flexible bristles of reduced diameter, for example 0.06 mm, acts somewhat like a comb, the teeth of which correspond to the crests of the various sections. In the case of a brush of hexagonal contour, that is, with six crests per section, and in which the core would include 16 spirals, for an approximate length of 26 mm, then there would be $6 \times 16 = 96$ bristles acting like 96 teeth of a comb, even though they are also fine bristles.

What is claimed is:

1. A brush for applying mascara to the eyelashes, comprising an elongated core defined by a metal wire folded to have at least two branches between which are disposed a row of bristles and which are twisted to form spirals to hold said bristles between said branches so that said core is at least partially surrounded by bristles held to extend radially from said core and distributed in substantially regular fashion so as to form at least one crest of long bristles surrounded by shorter bristles, the ends of the bristles defining a contour in projection in a plane perpendicular to the core, and the thickness of the crests measured at the periphery of the brush being equal to at most 3 mm, characterized in that the crests form a helix the pitch of which equals 1 to 4 times the length of the brush.

2. The brush of claim 1, characterized in that the contour has the shape of an ellipse.

3. The brush of claim 2, in which the end of the bristles in projection define elliptical contour, characterized in that the contour is eccentric with respect to the core.

4. The brush of claim 1, characterized in that the contour has the shape of a semi-circle closed with a triangle.

5. The brush of claim 1, characterized in that the contour has the shape of a shuttle.

6. The brush of claim 1, characterized in that the contour has the shape of a regular polygon having from three to six sides.

7. The brush of claim 1 in which the contour defined by the ends of the bristles substantially has the shape of an equilateral triangle, characterized in that a plurality of crests are provided with each crest rotated a one-quarter turn relative to an adjacent crest over the length of the brush.

8. A method of manufacture of a brush of the type for applying mascara to the eyelashes and having an elongated core that is at least partially surrounded by bristles held by and extending radially from said core and distributed in substantially regular fashion so as to form at least one crest of long bristles surrounded by shorter bristles, the ends of the bristles defining a contour in projection in a plane perpendicular to the core, and the thickness of the crests measured at the periphery of the brush being equal at most to 3 mm, comprising the steps of modifying the length of the bristles by peripheral milling or grinding so that the end of the bristles defines the desired contour and forms crests, and after milling or grinding, twisting the core by one-quarter to one turn, such that the crests form a helix having a pitch equal to from 1 to 4 times the length of the brush.

9. The method of claim 8, including the step forming the core by folding a metal wire over a row of bristles, twisting said thus-doubled wire such as to lock the bristles in place about the core in the form of helical rows of radial bristles, prior to modifying the length of the bristles by peripheral milling or grinding so that the end of the bristles forms the desired contour; and after milling or grinding, the core of the brush is twisted again in such a manner that the crests form the said helix having a pitch equal to from 1 to 4 times the length of brush.

* * * * *